United States Patent [19]

Eglinton

[11] 4,344,585

[45] Aug. 17, 1982

[54] SHEET HANDLING APPARATUS

[75] Inventor: Robert B. Eglinton, Huntington Beach, Calif.

[73] Assignee: Paxall, Inc., Chicago, Ill.

[21] Appl. No.: 128,025

[22] Filed: Mar. 7, 1980

[51] Int. Cl.[3] ..... B65H 17/12

[52] U.S. Cl. ..... 242/66; 242/DIG. 3

[58] Field of Search ..... 242/66, DIG. 3, 65, 242/75.1, 75.2, 56 R, 59, 67.1 R; 72/146, 148

[56] References Cited

U.S. PATENT DOCUMENTS

| | | | |
|---|---|---|---|
| 162,499 | 4/1875 | Rosquist | 242/65 |
| 1,248,542 | 12/1917 | Pope . | |
| 1,872,018 | 8/1932 | Street . | |
| 2,270,043 | 1/1942 | Fourness et al. | 242/65 |
| 2,618,945 | 11/1952 | Bellini | 242/65 X |
| 3,013,367 | 12/1961 | Sarre | 242/DIG. 3 |
| 3,098,619 | 7/1963 | Washburn . | |
| 3,250,484 | 5/1966 | Fair . | |
| 3,537,662 | 11/1970 | Keesling et al. . | |
| 3,592,403 | 7/1971 | Schmitt | 242/65 X |
| 3,931,940 | 1/1976 | Raighn et al. | 242/56 R |
| 4,160,528 | 7/1979 | Malone et al. | 242/66 X |

*Primary Examiner*—John M. Jillions
*Attorney, Agent, or Firm*—William W. Haefliger

[57] ABSTRACT

Rollable sheet handling apparatus receives advancement of a sheet in a longitudinally forward direction. The apparatus comprises:

(a) means to receive the advancing sheet and to roll same, (b) the means including support means over which the sheet travels, and auxiliary means including swingable arm means and rollers carried by the arm means to be movable between rearwardly collapsed position in which rolling of the sheet extent adjacent the support is initiated, and a series of forwardly extended positions in which rolling of the sheet is guided toward completion, and while the rollers engage the sheet extent being rolled, (c) the rollers being spaced to extend about, in roll forming relation, a portion of the sheet extent initially being rolled.

10 Claims, 6 Drawing Figures

SHEET HANDLING APPARATUS

BACKGROUND OF THE INVENTION

This invention relates generally to the handling of rollable sheets, and more particularly concerns equipment and method for rolling heavy or bulky sheets such as carpets.

In the past, the handling of heavy carpet rolls in warehouses to remove desired length carpet sections has been undesirably expensive in terms of involved labor cost. U.S. Pat. No. 3,931,940 describes apparatus which automatically unrolls, feeds, cuts and re-rolls carpet, thereby obviating the labor cost problems and also speeding up the handling of heavy carpet. However, there is continual need to simplify such apparatus and to improve its carpet or sheet handling capability. Also, there is need to improve, i.e. increase the reliability of the roll re-forming means, especially during starting of rerolling.

SUMMARY OF THE INVENTION

It is a major object of the invention to provide improved method and apparatus meeting the above described needs. Basically, and referring to the apparatus itself, it comprises:

(a) means to receive the advancing sheet and to roll same, (b) such means including support means over which the sheet travels, and auxiliary means including swingable arm means and rollers carried by the arm means to be movable between rearwardly collapsed position in which rolling of the sheet extent adjacent the support is initiated, and a series of forwardly extended positions in which rolling of the sheet is guided toward completion, and while the rollers engage the sheet extent being rolled, (c) the rollers being spaced to extend about, in roll forming relation, a portion of the sheet extent initially being rolled.

As will appear, clusters or groups of rollers are typically carried by the arm means, the clusters arranged to extend about the initially re-forming roll to aid and ensure its proper rolling formation, and at the same time the lead rollers of such clusters are positioned to urge the advancing sheet toward a support roll over which the sheet is being advanced toward the re-roll locus. Further, as the arm means swings forwardly during roll build-up, those lead rollers come into supporting positions relative to the built-up sheet roll.

Another object is to provide simple means to exert force yieldably urging the arm means toward collapsed position, and obviating the need for a fluid actuator or actuators to operate the arm means. As will appear, such force exertion is provided by a counterweight or counterweights connected to the arm means to exert constant torque on same; also, a handle is provided on the arm means to allow the operator to controllably increase or decrease torque application to the arm means during re-roll build-up.

Finally, stop means is provided to releasably stop rotation of the arm means at a predetermined angular position or positions during re-roll build-up. Such stop means may be actuated automatically when the arm means has swung into a position of predetermined roll build-up or into roll dump position, as will be seen.

These and other objects and advantages of the invention, as well as the details of an illustrative embodiment, will be more fully understood from the following description and drawings, in which:

DRAWING DESCRIPTION

DETAILED DESCRIPTION

Figure 1:
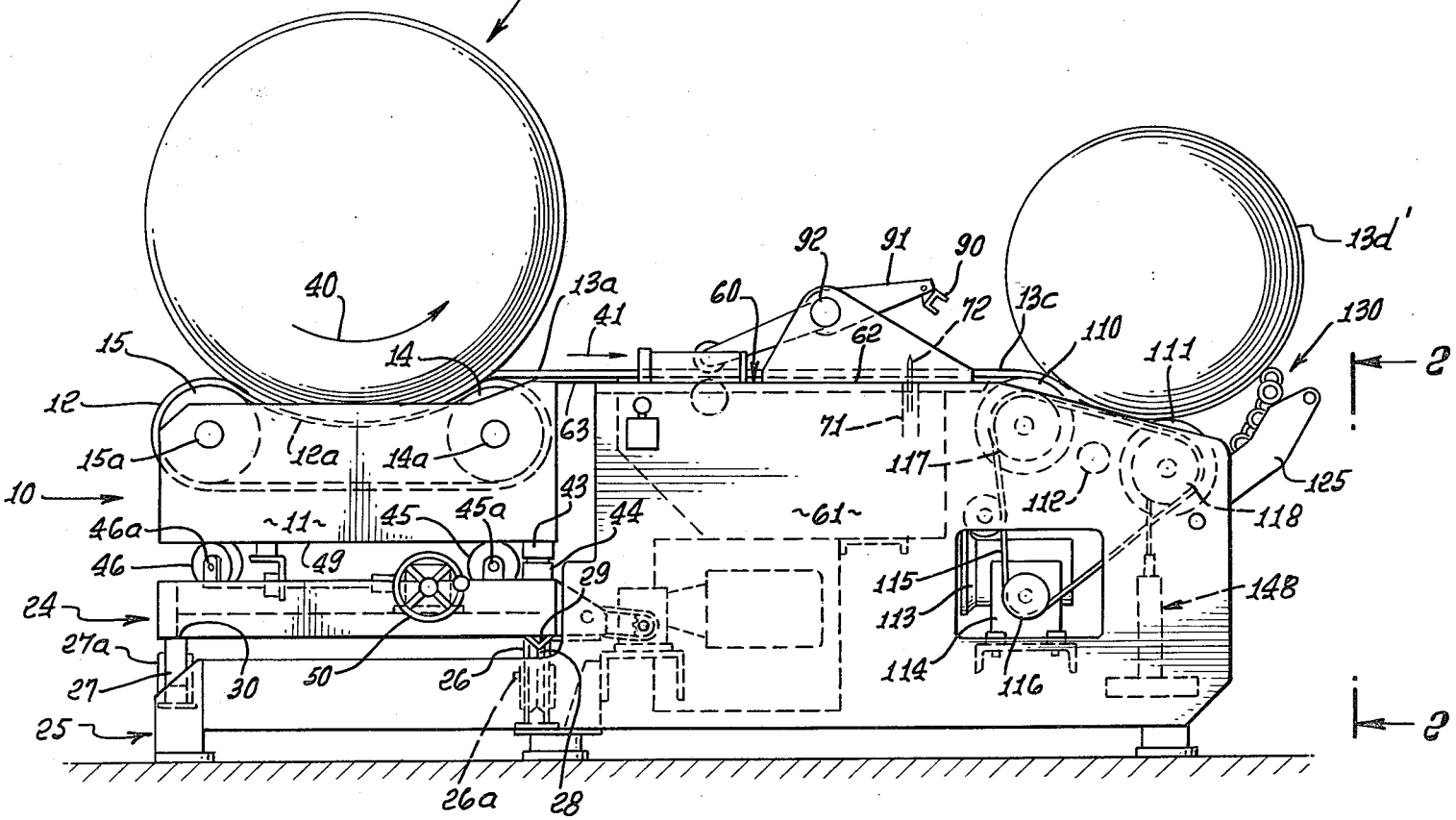
FIG. 1 is a side elevation of apparatus embodying the invention.

The illustrated carpet handling apparatus may for example take the form as described in U.S. Pat. No. 3,931,940. As such it comprises first means to rotate a sheet (such as a carpet) supply roll at a first station and in an unrolling direction to advance unrolled carpet extent in a generally longitudinally forward direction indicated by arrow 41 so that the carpet may be severed. In the example, such first means may with unusual advantage include a carriage 10 having a frame 11 and endless drive elements, as for example belts 12, to support and rotate the starting or supply carpet roll 13 in the direction indicated by arrow 40. The belts are laterally spaced apart and entrained about laterally elongated, longitudinally spaced rollers 14 and 15 having axles 14*a* and 15*a* carried by journals on the frame 11. As a result, the roll 13 is cradled or slung by the downwardly convex belt upper extent 12*a* between the rollers, for orienting the roll 13 during forward feeding of the unrolled extent 13*a* over and forwardly beyond the roller 14. The latter may be driven as by a reversible drive for driving the belts which in turn rotate the carpet roll in either direction, as desired. Such a drive is described in U.S. Pat. No. 3,931,940.

Structure may be provided to support the carriage for adjustable lateral displacement i.e. normal to the plane of FIG. 1, as also described in U.S. Pat. No. 3,931,940. Such structure may include an undercarriage 24 supporting carriage 10, and movable laterally relative to the main frame 25 of the overall apparatus. In this regard, forward and rearward fixed position wheels 26 and 27 may be journaled by the main frame as at 26*a* and 27*a* to support the undercarriage; thus, forward wheels may define V-cross section annular grooves 28 guidingly receiving the V-shaped lateral channel 29 attached to the underside of carriage 24, and the peripheries of the rear wheels 27 may directly engage the flat underside of the carriage 24, as at 30. A suitable drive to shift the carriage laterally may be provided.

Means is also provided to support carriage 10 to pivot about a vertical axis. Thus the two carriages may be pivotally intercoupled as via members 43 and 44. Pivot wheels as at 45 and 46 are journaled to the undercarriage as at 45*a* and 46*a*, so that the underside 49 of carriage 10 may rest on such wheels, rotation of the latter accommodating pivoting of the supported carriage 10. Drive means to effect such pivotal movement may include a manually rotatable wheel 50 operating via structure described in U.S. Pat. No. 3,931,940 to rotate the carriage 10 about the described vertical axis thereby to accurately direct forward travel or "squaring" of the unrolled extent 13*a* of the carpet, and in relation to cutting and re-rolling structure to be described. Note that the axes of wheels 45, 46 and additional wheels are directed to intersect the vertical axis.

As a result of such lateral shifting and pivoting of the carriage 10, the roll 13 may be positioned so that the opposite side edges of the carpet unrolled extent 13*a* seen in FIG. 1 are correctly oriented for accurate measuring, cutting and re-rolling of the carpet section subject to severing.

The carpet handling apparatus may, with unusual advantage, also include support means located generally forwardly of the carriage 10 and roll 13 to receive and support the advancing unrolled carpet extent 13*a*, and in position to be severed at a selected longitudinal location along the carpet length. In the example seen, the support means may include a plate or table 60 supported by main frame structure 61 so that the table provides an upwardly presented surface. A transfer plate may be provided at 63 to extend rearwardly from overlapping relation with the table rear edge toward the roller 14, for supporting the unrolling carpet as it travels forwardly from belts 12 onto the table.

The support means may include a gas or air bearing operating to at least partially float the unrolled carpet extent advancing over the table, thereby to reduce sliding friction tending to develop as the carpet 13*a* slidably advances over the table. See for example the description of such a gas or air bearing in U.S. Pat. No. 3,931,940.

Also provided is a cutter supported for movement laterally crosswise of the unrolled carpet 13*a* and in severing relation therewith, proximate the table. In the example, the table forms a through slot 71 extending lengthwise laterally crosswise of the table, and opening at surface 62. The illustrated cutter comprises a rotary blade 72 the uppermost cutting edge of which projects through and above the slot, the blade being rotatable about a forwardly extending axis as by a motor. A carrier for the motor and blade is located to travel the blade lengthwise of the slot 71, for severing the carpet unrolled extent crosswise thereof, freeing a selected length section 13*c* of the carpet for re-rolling to form final roll 13*d*. One such carrier is described in U.S. Pat. No. 3,941,940. Note that plenum chamber air or gas can escape upwardly through the slot to float the carpet extent directly above the slot.

For safety purposes, a laterally elongated U-shaped channel member or shield 90 is displaced downwardly over the carpet directly above the slot and blade edge during cutting. The channel is carried on laterally spaced rocker arms 91 carried on a laterally extending rocker shaft 92. An actuator, not shown, lifts the channel 90 to allow forward advancement of the carpet sections 13*a* and 13*c* and lowers the channel during transverse cutting of the carpet as described. Shield 90 also provides damping. Suitable metering of the travel of the carpet or strip may be provided as described in U.S. Pat. No. 3,931,940.

Figure 2:
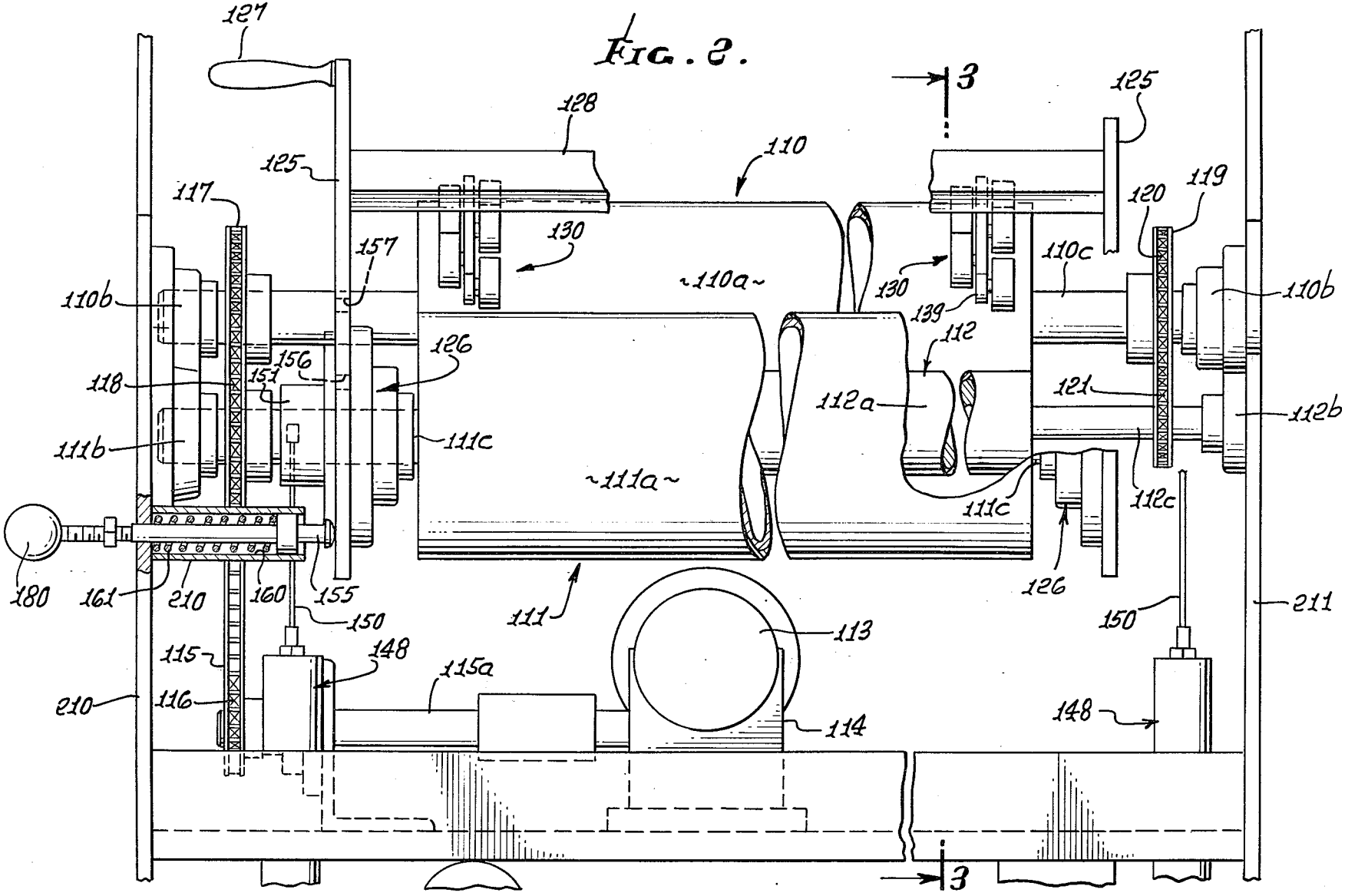
FIG. 2 is an enlarged right end elevation taken on lines 2—2 of FIG. 1.
Figure 3:
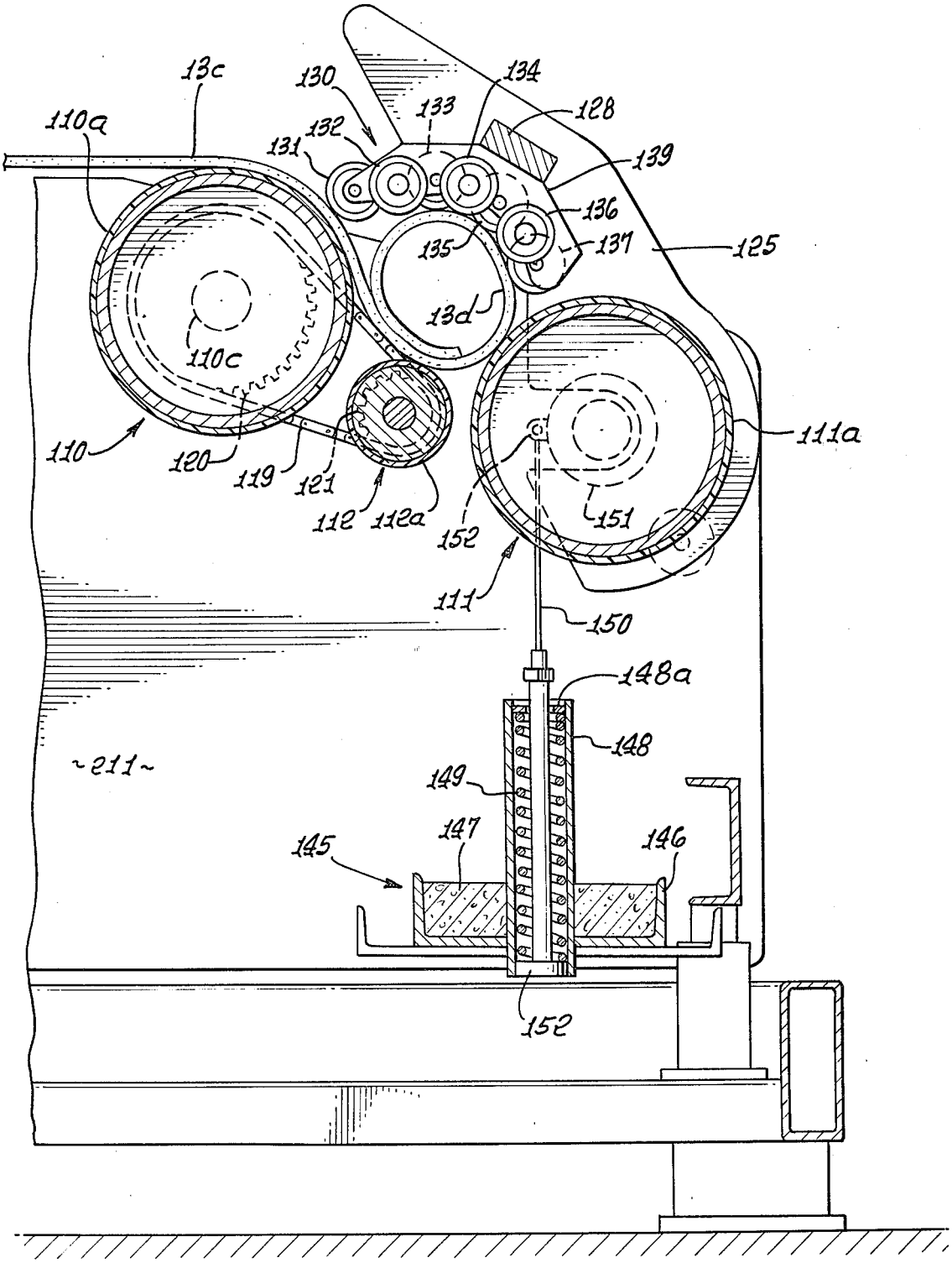
FIG. 3 is a vertical section taken on lines 3—3 of FIG. 2.
Figure 4:
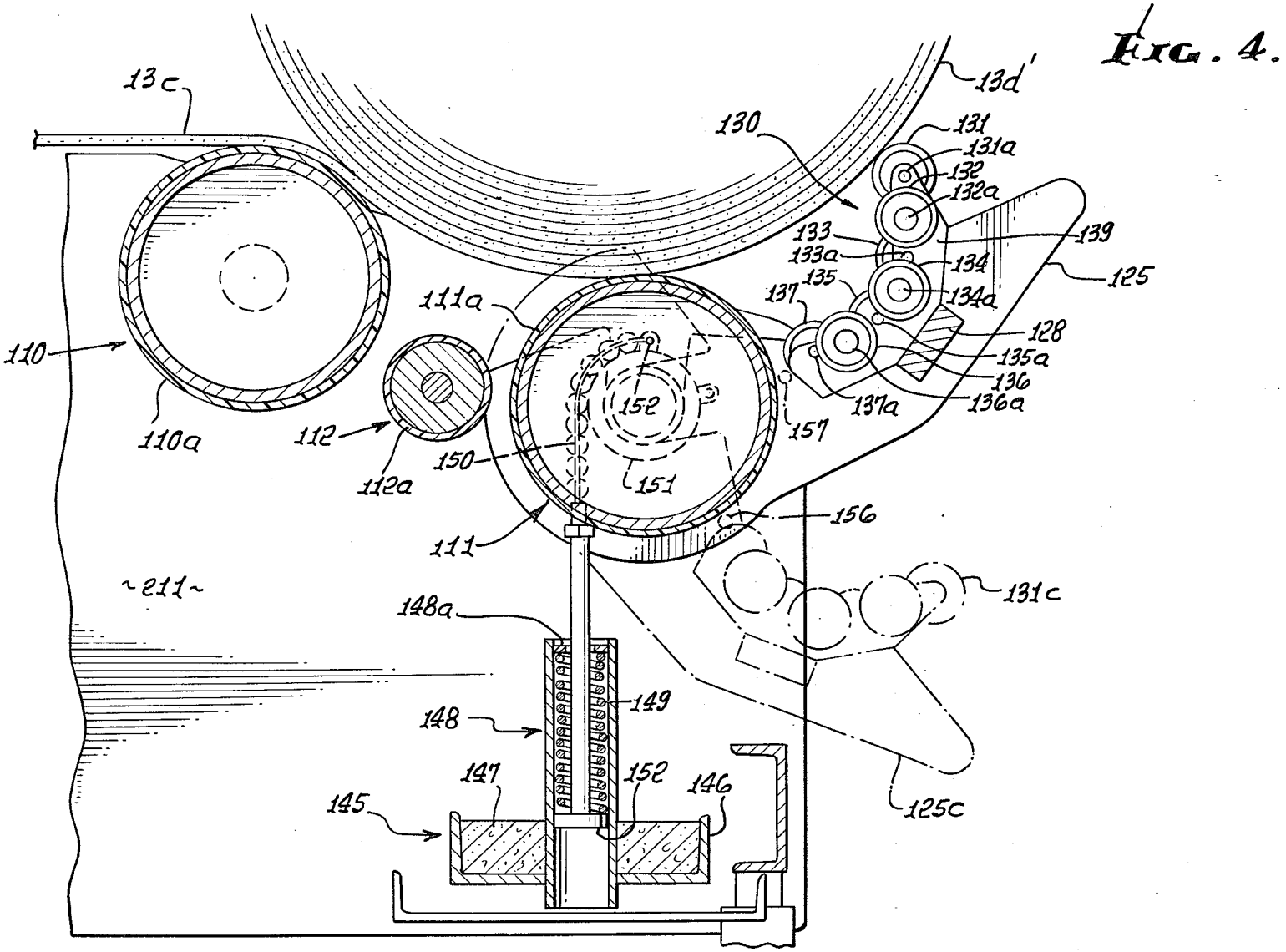
FIG. 4 is a view like FIG. 3, but showing a sheet roll at an intermediate stage of roll-up.

The carpet handling apparatus also comprises means to receive the severed or unsevered carpet section 13*c* at a subsequent station located generally forwardly of the first station, and to re-roll the section 13*d* for forming a final roll 13*d*'. Such other means may advantageously include endless support roller mechanism such as first and second main support rollers 110 and 111 seen in FIGS. 1–4 and a third roller 112 between 110 and 111, all being parallel. All three rollers may have grip surfacing as at 110*a*, 111*a* and 112*a*, the first and second rollers have substantially the same diameters, the second roller 111 is at a lower level than the first 110, and the third 112 has a substantially smaller diameter than the first two and its top surface is below top surface level of roller 111. As a result, the second and third rollers 111 and 112 initially seat the carpet section as it initially forms the re-roll 13*d*, in FIG. 3, and the first and second rollers 110 and 111 are located to seat the carpet re-roll during build-up as seen in FIG. 4. As shown in FIG. 2 the rollers 110–112 may be end journaled at 110*b*, 111*b* and 112*b*; further, all three rollers may be driven in the same rotary direction as by means of motor 113 seen in FIG. 2, gear box 114, shaft 115*a* chain 115 driven by sprocket 116 and driven sprockets 117 and 118 on rollers 110 and 111, the chain 119 entrained on sprocket 120 on roller 110 and sprocket 121 on roller 112. Shafts for the rollers appear at 110*c*, 111*c* and 112*c*. Side frame members appears at 210 and 211.

Auxiliary means is provided to be movable between rearwardly collapsed position in which re-rolling of the carpet section adjacent rollers 110–112 is initiated, and series of forwardly extended positions in which such rerolling is guided toward completion, and while the auxiliary means engages the carpet section being re-rolled. In the example, the auxiliary means includes swingable arm means, and smaller rollers carried by the arm means, the latter rollers being spaced to extend about, in roll forming relation, a portion of the sheet or carpet extent initially being rolled, as seen in FIG. 3. Thus, the arm means may include two arms 125 spaced laterally apart as shown in FIG. 2, and journaled as at 126 about shaft 111*c* associated with support roll 111. A handle 127 on one arm 125 enables manual swinging of the two arms 125, which are interconnected by a lateral brace or beam 128.

The smaller rollers are shown in groups or clusters 130, each of which includes rollers 131–137 spaced in overlapping relation, as appears in FIGS. 3 and 4. Each roller cluster is supported by a carrier 139 to which the free-wheeling rollers are connected as via axles 131*a*–137*a*, and each carrier is attached to the lateral brace or beam 128. Note in FIG. 3 that the lead roller 131 in each cluster or group holds the sheet 13*c* extent passing over roll 110 against that roll; and that rollers 132–137 at that time shape the carpet or sheet being coiled at 13*d* above rolls 111 and 112. Thus, rolls 110–112 and rollers 132–137 form a coiling pocket or zone the perimeter of which is oval-shaped to ensure that the sheet will become coiled. The surfaces of the rollers 131–137 may have sheet-gripping material thereon, as for example rubber "tires". Note further in FIG. 3 that the surfaces of the rollers 132–137 closest the coil 13*d* form a concave zone to shape the coil and turn the advancing sheet material back toward rolls 110 and 112.

In FIG. 4 it is clear that the lead roller 131 of each cluster, in forwardly extended positions of the arms 125, is presented toward the underside of the built-up sheet roll 13*d*', in supporting relation with same.

Figure 5:
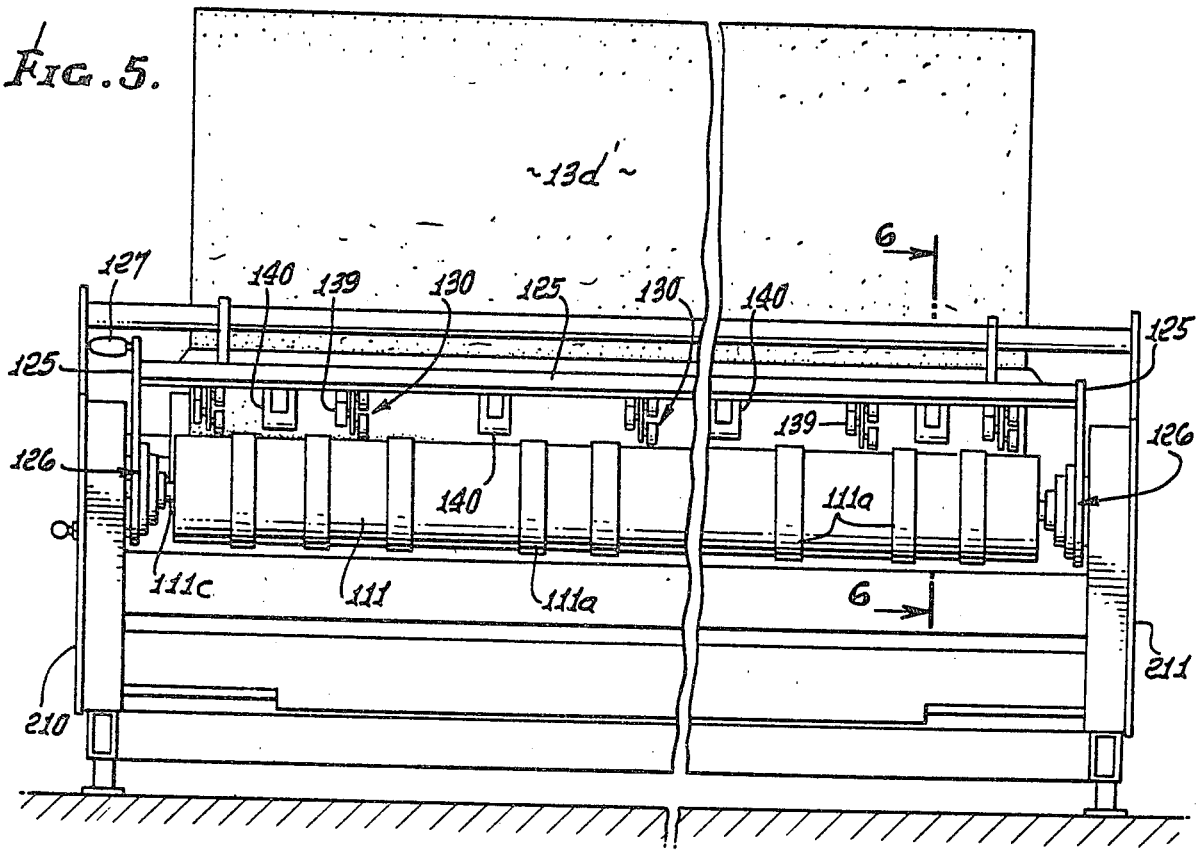
FIG. 5 is a vertical section through modified apparatus of the general type as shown in FIGS. 1–4.
Figure 6:
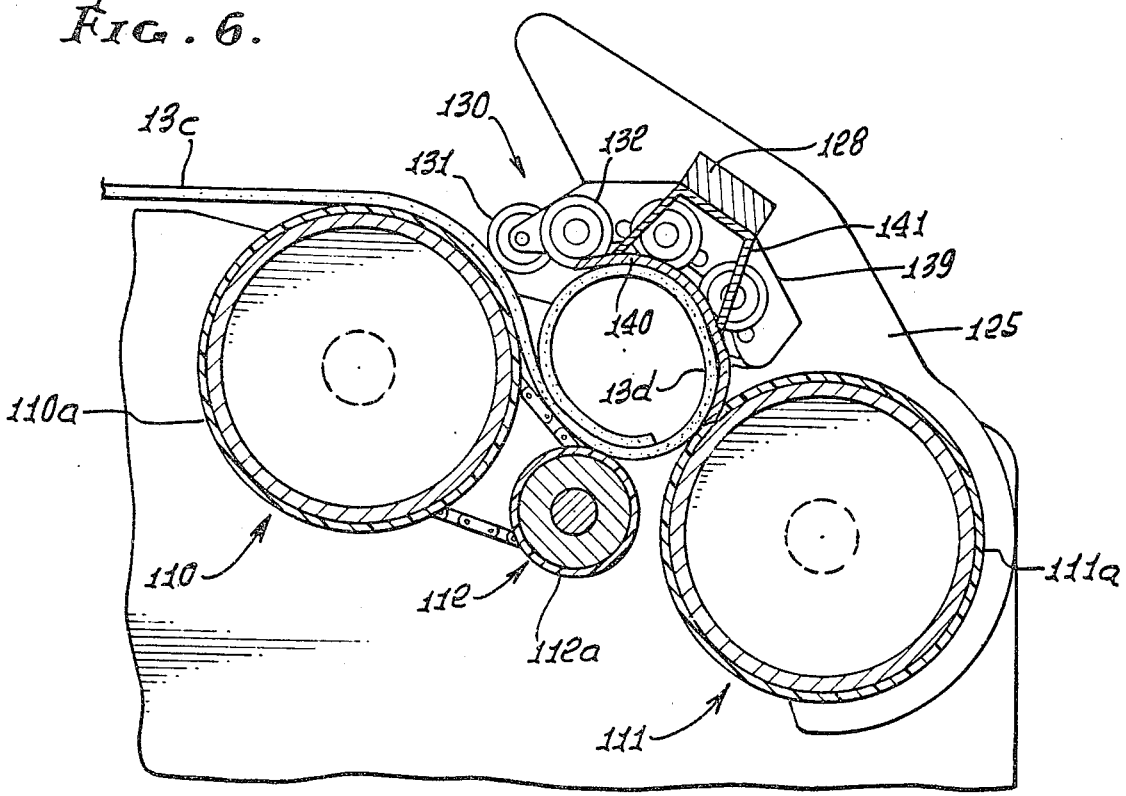
FIG. 6 is an enlarged section on lines 6—6 of FIG. 5.

In FIGS. 5 and 6 the auxiliary means also includes multiple laterally spaced shields 140 in the path of the carpet advancing past or over the roller 110 and deflected upwardly by roller 111, the shields being concave toward the advancing carpet to form the carpet as shown. The shield or shields are also carried by brace 128 and as via brackets 141 to act in conjunction with the rollers of clusters 130, the shields being laterally spaced apart between the roller clusters. The shields project closer to roll 111 than the outer surfaces of grip surfacing 111*a*, formed as axially spaced annuli, so as to "pick up" the carpet and form same. The shields may consist of molded tetrafluoroethylene.

Means is also provided to exert force yieldably urging the arm structure toward rearwardly collapsed position (see FIG. 3) but also accommodating forward swinging of the arm structure during build-up of the roll 13*d'*. Such means advantageously comprises a counterweight, or counterweights, operatively connected to exert torque on the arm means. As shown in FIGS. 1–4, each counterweight 145 includes a receptacle 146 for ballast such as concrete 147, a vertical cylinder 148 being attached to the receptacle. Additional ballast may be added, or ballast removed, for adjustment. A 152 plunger projects in the cylinder and the cylinder is suspended via a compression spring 149 between the plunger and cylinder shoulder 148*a*. The plunger is connected to chain or line 150 that wraps partly about a hub 151 of arm 125, the end of the chain attached at 152 to that hub. Accordingly, constant counterclockwise torque is exerted on the arm 125 by the counterweight, in FIGS. 3 and 4, and sudden movement of the arm 125 is cushioned by the spring 149. Two such counterweights are shown, at opposite ends of the rolls 111, and respectively adjacent the two arms 125, as viewed in FIG. 2.

Finally, stop means is provided to releasably arrest or stop rotation of the arm means at a predetermined angular position thereof. Thus, the roll 13*d* may become positively supported at predetermined fixed elevation by the arm means and rollers 131, as in FIG. 4 position for example, i.e. prior to subsequent continued clockwise rotation of the arm means to roll dump position, indicated by broken lines 125*c*. FIG. 2 shows the provision of a stop plunger 155 insertible into one of the stop openings 156 and 157 in the left arm 125. Opening 156 may correspond to the solid line arm position in FIG. 4, and 157 to the dump position 125*c* of that arm. The plunger is retained at a fixed elevation by horizontal bore 160 in cylinder 210 within which the plunger is horizontally slidable. A spring 161 in cylinder 210 biases the plunger to the right, i.e. toward and against the arm 125, so as to urge the plunger first into opening 156 to stop the arm in FIG. 4 full line position, and (when released) to urge the plunger into opening 157 in arm dump position. Handle 180 on the plunger allows it to be pulled back to release the stop. Thus, the roll can be rapidly built-up to FIG. 4 position and held; and thereafter it can be dumped by retracting plunger 155. In this regard, the counterweight torque may be adjusted to cause the arm means to allow efficient roll build-up as the arm moves toward first stop position. Accordingly, fluid pressure actuator means for rotating the arm means are not required, the present structure being very simple and reliable.

From the foregoing, it is seen that the invention enables efficient and rapid semi-automatic handling of pliable sheets to be measured and/or re-rolled, and/or inspected, and/or cut to measured length. Typical pliable sheets include carpet, linoleum, paper, cardboard, rug cushioning materials, foam rubber, urethane foam, felt padding, textiles, canvas, roofing felt, burlap, plastics, leather, cork, etc; however, the invention has especially advantageous application to carpet.

I claim:

1. In rollable sheet handling apparatus, and wherein a sheet is subject to advancement in a generally longitudinally forward direction, (a) means to receive the advancing sheet and to roll same, (b) said means including support means over which the sheet travels, and auxiliary means including swingable arm means and rollers carried by the arm means to be movable between rearwardly collapsed position in which rolling of the sheet extent adjacent the support is initiated, and a series of forwardly extended positions in which rolling of the sheet is guided toward completion, and while the rollers engage the sheet extent being rolled, (c) said rollers being spaced to extend about, in roll forming relation, a portion of the sheet extent initially being rolled, (d) said rollers being clustered in groups which are laterally spaced apart, each roller group defining a concave zone facing the sheet as it is initially coiled, to receive and shape the coil, (e) said support means including multiple elongated rolls to support the sheet as it is initially coiled and subsequently rolled up, one of the rollers in each clustered group holding the sheet against one of the support rolls during initial coiling of the sheet, (f) said auxiliary means including shields carried by the arm means to be laterally spaced apart and located between and spaced from said clustered roller groups, to project in the path of sheet advancement and co-operate with rollers of said clustered groups in initiating coiling the sheet, the shields being concave toward the sheet, (g) another of said elongated rolls being spaced forwardly of said one roll and having fixed position, there being sheet gripping annuli on said other roll, and wherein said shields carried by said arm means initially project in the path of sheet advancement toward said other roll and closer to said other roll than the surfaces of said sheet gripping annuli, said shields carried by said arm means to swing about an axis defined by said other roll.

2. The apparatus of claim 1 including means exerting force yieldably urging said arm means toward said collapsed position.

3. The apparatus of claim 2 wherein said force exerting means comprises a counterweight operatively connected to exert torque on said arm means.

4. The apparatus of claim 3 including yieldable means connected to transmit loading from the counterweight to the arm means.

5. The apparatus of claim 4 including a handle on the arm means to facilitate operator application of torque to the arm means during re-roll build-up.

6. The apparatus of claim 1 wherein the rollers of each group define a concave zone facing the sheet as it is initially coiled, to receive and shape the coil, the shields laterally offset from said concave zones.

7. The apparatus of claim 6 wherein said one roller of each clustered group in forwardly extended position of the arm means is presented toward the underside of the built-up sheet roll in supporting relation therewith.

8. The apparatus of claim 1 including stop means to releasably stop rotation of the arm means at a predetermined angular position thereof.

9. In rollable sheet handling apparatus, and wherein a sheet is subject to advancement in a generally longitudinally forward direction, (a) means to receive the advancing sheet and to roll same, (b) said means including support means over which the sheet travels, and auxiliary means including swingable arm means and rollers carried by the arm means to be movable between rearwardly collapsed position in which rolling of the sheet extent adjacent the support is initiated, and a series of forwardly extended positions in which rolling of the sheet is guided toward completion, and while the rollers engage the sheet extent being rolled, (c) said rollers being spaced to extend about, in roll forming relation, a portion of the sheet extent initially being rolled, (d) there being means exerting force yieldably urging said arm means toward said collapsed position, said force exerting means comprising a counterweight operatively connected to exert torque on said arm means, and including yieldable means connected to transmit loading from the counterweight to the arm means, (e) said force exerting means including a line connected to a hub integral with the arm means, a plunger attached to the line, said yieldable means including a spring, there being a cylinder integral with the counterweight and within which loading is transmitted between the cylinder and plunger via the spring.

10. In rollable sheet handling apparatus, and wherein a sheet is subject to advancement in a generally longitudinally forward direction, (a) means to receive the advancing sheet and to roll same, (b) said means including support means over which the sheet travels, and auxiliary means including swingable arm means and rollers carried by the arm means to be movable between rearwardly collapsed position in which rolling of the sheet extent adjacent the support is initiated, and a series of forwardly extended positions in which rolling of the sheet is guided toward completion, and while the rollers engage the sheet extent being rolled, (c) said rollers being spaced to extend about, in roll forming relation, a portion of the sheet extent initially being rolled, (d) there being stop means to releasably stop rotation of the arm means at a predetermined angular position thereof, (e) the stop means including a plunger insertible into any of two or more stop openings on the arm means, the plunger carried by fixed frame structure, and a spring to urge the plunger into the opening when the arm structure has swung into a position corresponding to predetermined extent of roll build-up.

* * * * *